United States Patent [19]

Barbier et al.

[11] Patent Number: 4,737,618

[45] Date of Patent: Apr. 12, 1988

[54] HEATING ELEMENT FOR A DEFROSTING DEVICE FOR A WING STRUCTURE, SUCH A DEVICE AND A PROCESS FOR OBTAINING SAME

[75] Inventors: Philippe Barbier, Paris; Alain Cohendy, Dugny; Remy Reynet, Simiane Collongue, all of France

[73] Assignee: Aerospatiale Societe Nationale Industrielle, Paris, France

[21] Appl. No.: 813,197

[22] Filed: Dec. 24, 1985

[30] Foreign Application Priority Data

Dec. 26, 1984 [FR] France ..... 84 19801

[51] Int. Cl.[4] ..... H05B 3/00

[52] U.S. Cl. ..... 219/548; 219/520; 338/225

[58] Field of Search ..... 219/202, 520, 542, 544, 219/548, 552, 553; 338/225; 244/134 R, 134 D

[56] References Cited

U.S. PATENT DOCUMENTS

| | | | |
|---|---|---|---|
| 2,884,509 | 4/1959 | Heath | 338/208 |
| 3,146,340 | 8/1964 | Dewey et al. | 219/520 |
| 3,178,560 | 4/1965 | Mapp et al. | 219/528 |
| 4,301,356 | 11/1981 | Tanei et al. | 338/225 |

FOREIGN PATENT DOCUMENTS

| | | | |
|---|---|---|---|
| 0022919 | 6/1980 | European Pat. Off. . | |
| 0038922 | 3/1981 | European Pat. Off. . | |
| 1254264 | 11/1967 | Fed. Rep. of Germany . | |
| 2147137 | 5/1971 | Fed. Rep. of Germany . | |
| 2316707 | 10/1973 | Fed. Rep. of Germany . | |
| 2307640 | 8/1979 | Fed. Rep. of Germany . | |
| 2356336 | 1/1978 | France . | |
| 613655 | 12/1948 | United Kingdom . | |
| 1115023 | 5/1968 | United Kingdom . | |
| 197708 | 10/1977 | U.S.S.R. | 219/548 |

*Primary Examiner*—E. A. Goldberg
*Assistant Examiner*—C. M. Sigda
*Attorney, Agent, or Firm*—Armstrong, Nikaido, Marmelstein & Kubovcik

[57] ABSTRACT

An electric resistance element (1) in a device for deicing a wing structure such as the wing of an aircraft or the blades of a helicopter, which includes conducting fibers embedded in a composite fiber structure and power supply wires connected electrically to said conducting fibers. In this element, the conducting fibers are carbon fibers in the form of at least one ribbon (2) in which the fibers are oriented longitudinally, preimpregnated with resin and at least one end of which is fixed in a deformable tubular metal mesh element (3) providing the electric connection by contact with the ribbon and which in turn is soldered to the corresponding power supply wire (4).

5 Claims, 2 Drawing Sheets

9
10a
12

10
11

9
10

9

17
16

14
13
15
16

9
12
13
14

9
12
13
10a

HEATING ELEMENT FOR A DEFROSTING DEVICE FOR A WING STRUCTURE, SUCH A DEVICE AND A PROCESS FOR OBTAINING SAME

It is known that the formation of ice, on the fuselages and wings of aircraft is due to a cold surface (temperature less than 0° C.) meeting with supercooled drops of water contained in the atmosphere. There then occurs ice deposits on the surface and, within the field of wings in general and particularly the rotating wings of helicopters, the most important occur on the leading edge and in the vicinity thereof of the wing structure. This results in modifications of the profile of the wings or of the blades which may be prejudicial to their aerodynamic qualities.

Different types of devices are known for deicing these critical zones and one of them consists in heating these zones by means of electric resistances.

Several kinds of resistance have been employed for accomplishing this function. All have drawbacks such that deicing by heating remains a question which, at the present time, is not yet solved in an entirely satisfactory way. Thus, metal resistances have been placed under a metal protection bonded to the leading edge of the wings. The whole of this device is fairly fragile and of a relatively short lifespan. Should a breakdown occur, it is practically impossible to make a repair without changing the whole of a device.

The technique tended then towards "heating panels" namely the positioning of plates or covers of a composite fiber structure in which are dispersed conducting fibers, (whether they are made from boron or carbon). The electric power supply intended to flow through the fiber is provided by connecting wires to a metal frame fixed to the edge of the panel and held in contact with the fibers or to a metal deposit, formed by vaporization or electrolytically, at the ends of the panel contained in the fibers. Besides the disadvantages of being complex to fit and arrange, these devices have a major defect in so far as the electric contacts are concerned which are required between the fibers and the supply wires. It is in fact known that the resins used in composite materials have a fairly average adhesive power, so that there is a risk of the metal foils distributing the power to the fibers becoming unstuck. Improvement of the bonding leads to increasing the resistance of the contact points which results in very localized over heating, damaging to the bonding agent and resin and so causing the mechanical connection to become fragile and the electrical connection to break. Furthermore, the extra thick portions which exist at the positions of the electric connections are detrimental to the aerodynamic profile of the wind and form a hindrance in the correct positioning of structures shielding and protecting the leading edges against shocks and erosion.

The present invention intends overcoming these drawbacks by proposing a deicing device in which the heating element or elements are integrated without impairing the strength of the leading edge of the wing, and are connected to power supply wires in an extremely stable way without forming critical points either from the electrical point of view or from the mechanical point of view. The device is moreover obtained using a simple manufacturing process which allows it to be readily adapted to the wing or blade profile to be equipped, even to be integrated therein at the very time of manufacture of the wing or blade.

For this, the first object of the invention, is to provide an electric resistance element forming part of a device for deicing a wing structure such as the wing of an aeroplane or the blades of a helicopter comprising conducting fibers embedded in a composite fiber structure and power supply wires connected electrically to said conducting fibers.

According to one of the main features of the invention the conduction fibers are carbon fibers in the form of at least a ribbon in which the fibers are orientated longitudinally, preimpregnated with resin and one end at least of which is fixed in a deformable tubular metal mesh element providing the electric connection by contact with the ribbon and by soldering or crimping with the corresponding power supply wire.

A second object of the invention resides in a deicing device comprising at least one of said elements and which is formed by a length, determined as a function of the resistance to be obtained, of said carbon fiber ribbon, including the part of the ribbon covered by said tubular element, disposed between at least two layers of a composite material so as to form a heating cover.

Furthermore, said element may be formed from at least two lengths of parallel ribbons side by side disposed on each side of an insert layer of composite material and connected in series by one of their ends by means of a length of ribbon overlapping said ends not covered by said insert layer.

Finally, a third object of the invention is a process for forming the above deicing device in which the heating cover is formed flat then is placed between a mold part and a counter mold part where it is polymerized under pressure so as to obtain the profile of the leading edge of the wind structure to be equipped.

The device thus formed may then be fixed on the wing structure. The device formed flat may also be disposed between the mold part and the counter mold part forming the device for molding the wing structure itself made from a composite material of the same kind as that of the heating cover.

The invention will be better understood from the description given hereafter by way of example which is purely indicative and in no wise limitative of the advantages and secondary features of the invention.

Reference will be made to the accompanying drawings in which.

Figure 1:
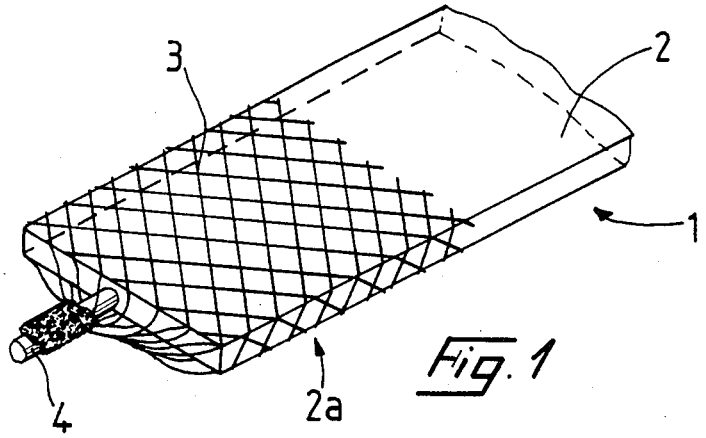
FIG. 1 illustrates schematically the main features of the element of the invention.

Referring first of all to FIG. 1 the end of an element 1 can be seen, resistant from the electric point of view, formed by a ribbon 2 of carbon fibers oriented parallel to the longitudinal dimensions of the ribbon, and preimpregnated with a resin capable of being polymerized and hardened. It will be noted that, for a section of three square millimeters the section of pure carbon is, in a ribbon used, of the order of 1.9 $mm^2$. One of the ends 2*a* of the ribbon is covered by a tubular mesh element 3 formed by knitting an appropriate metal wire. To this knitted structure a power supply wire 4 is soft soldered in a zone where the sleeve is gathered together about the wire and/or in a zone of the sleeve covering both the ribbon and one end of the wire which is introduced therein.

One of the advantages of the electric connection thus formed resides in the fact that the knitted metal structure is readily impressed in the resin of the carbon ribbon which, after polymerization under pressure, forms an engagement means having very good tear strength. The intimate contact between the metal wires and the carbon fibers of the ribbon is a fact ensuring a good quality of the electric contact.

Figure 2:
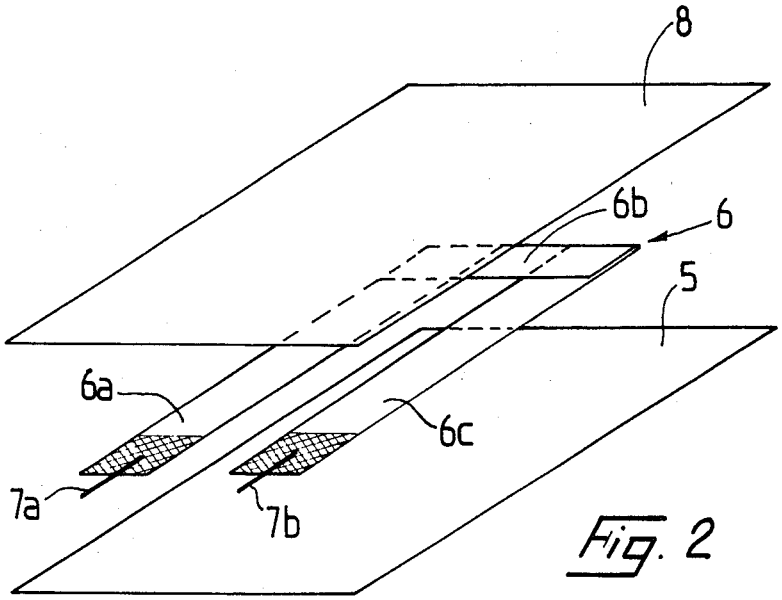
FIG. 2 illustrates the general construction of a deicing device.
Figures 3, 4, 5, 6, 7, 8, 9, 10:
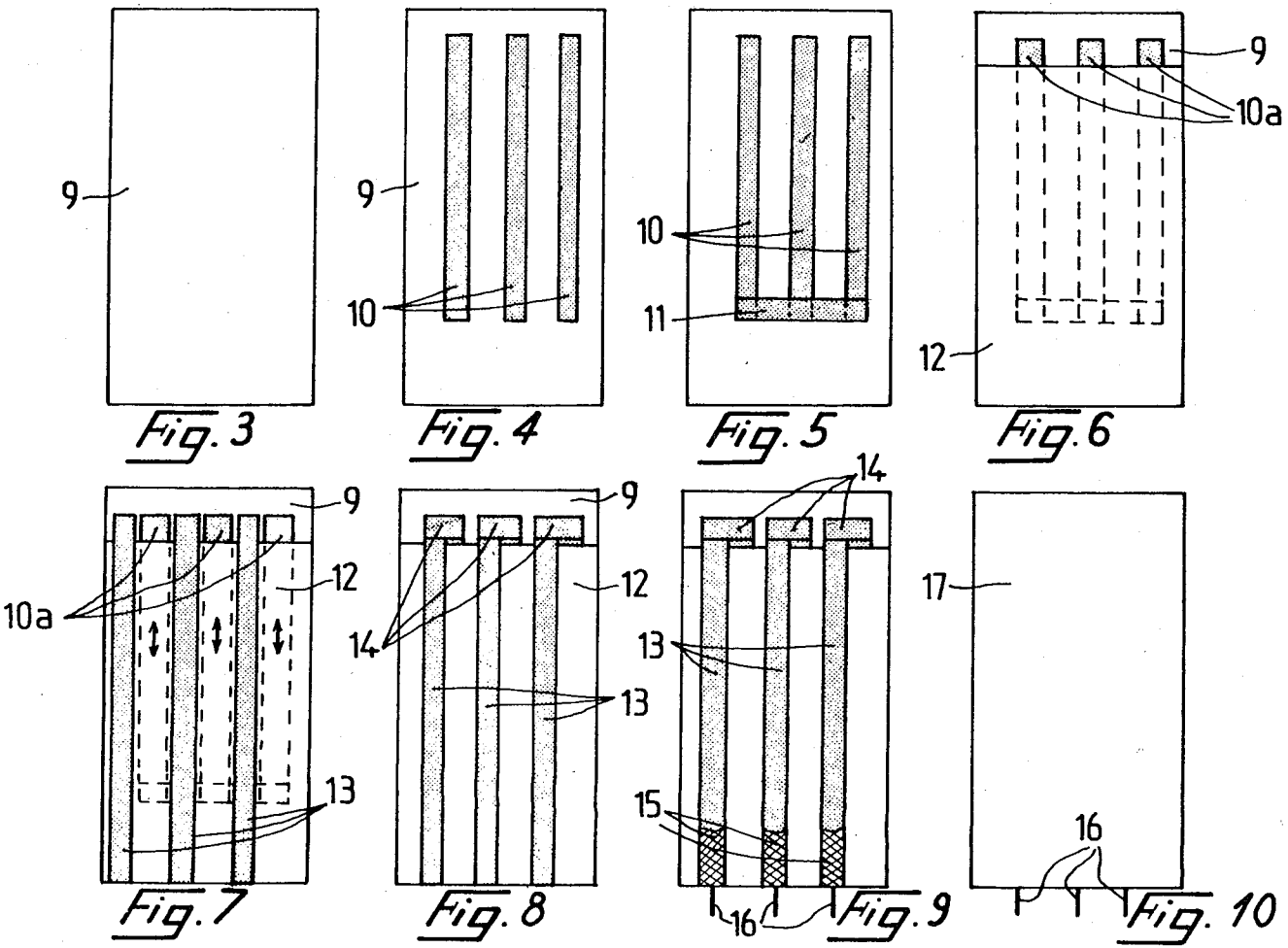
FIGS. 3 and 10 illustrate the successive steps in manufacturing a deicing device in which the resistant elements are mounted in the form of a star for being supplied from a three phase current source.

FIG. 2 shows that, for forming a deicing device with said element 1, on an insulating base substrate 5 (for example a glass fabric preferably preimpregnated) and having dimensions corresponding to the expanded form of the device, there is disposed an element 6 such as said element 1 which is here formed by three sections *6a*, *6b*, *6c* of carbon fiber ribbon which form an electric resistance of a value which will depend, for a given section of the ribbon, on the total length of element 6. The free ends of section *6a* and *6c* are equipped with tubular knitted portions soldered to the connection wires *7a*, *7b*. A second protection layer 8 identical to layer 5 covers this latter and the element 6 which it carries. The cover thus formed may be polymerized under pressure between a mold part and a counter mold part reproducing the profile of the wing on which the device will be fixed. Care will be taken to place substrates 5 and 8 so that they completely cover the ends of section *6a* and *6c* sheathed with the knitted sleeve so that only conductors *7a* and *7b* are situated outside the assembly. The pressure applied during polymerization allows, on the one hand, the sleeves to be firmly anchored in the resin of the ribbon and, on the other hand, an intimate contact to be provided between the two sections *6a*, *6c* creating an efficient insulation of one with respect to the other.

Furthermore, since section b was simply laid at the end of sections *6a* and *6c*, the pressure also allows a good electric continuity to be obtained therebetween.

FIGS. 3 to 10 illustrate the construction of a deicing device intended to be supplied with power from a three phase source. On a support substrate 9 similar to that 5 of FIG. 2, are placed three sections 10 of preimpregnated carbon fiber ribbon, parallel to each other and spaced evenly apart from each other over a distance at least equal to the width of the ribbon. A ribbon section 11 overlapping one of their three ends forms the common element in the triangle mounting the three resistances which the device will comprise. An insert layer 12, also made from a glass fabric preferably preimpregnated, is then placed on sections 10 and 11 so as to leave the ends *10a* of sections 10 uncovered. On this insert layer 12 and between sections 10 are again placed three sections 13 of carbon fiber ribbon so that one of their ends is beside said ends *10a* whilst their other end is flush with the lower transverse edge of layer 9. The electric continuity between each section 10 and the corresponding section 13 is provided by means of small sections 14 which overlap them two by two in the zone left uncovered by the insert layer 12 . The free ends of sections 13 are then provided with knitted metal tubular sleeves 15 themselves soldered to the power supply wires 16. Finally, a protective substrate 17 identical to substrate 9 covers the whole.

The deicing device formed very simply when flat may then be polymerized under pressure to the shape required in an appropriate mold. It may also be incorporated in the very mold used for forming the wing structure (aircraft wing or helicopter blade) itself made from a composite material. In this latter case, substrates 9, 12 and 17 will be chosen of the same kind as those which are used for forming the wings or blades.

The invention finds an interesting application in the aeronautic field.

We claim:

1. A device for deicing a wing structure of a heavier-than-air craft including an electric resistance element comprising conducting carbon fibers in the form of at least one ribbon having opposite ends, the fibers being oriented longitudinally and preimpregnated with resin, at least two ribbon sections, each ribbon section including plural ones of said at least one ribbon, means for electrical connection to at least one of said ribbon sections, at least two layers of preimpregnated composite fiber material forming an electrically insulating heating cover, an insert layer made of an insulating composite material positioned between said at least two layers, each ribbon section extending in parallel and side-by-side between said insert layer and one of said at least two layers, said plural ones of said at least one ribbon each having a length longer than a length of said insert layer and one end extending beyond said insert layer, and plural ribbon connectors electrically connecting in series pairs of said one ends of said plural ones of said at least one ribbon.

2. A deicing device as claimed in claim 1, wherein said means for electrical connection to at least one of said ribbon sections comprises a knitted tubular metal mesh element coveringly engaged and fixed to an end opposite said one end of at least one of said plural ones of said at least one ribbon, and a power wire soldered to said tubular metal mesh element.

3. A deicing device as claimed in claim 2, wherein said metal mesh element is impressed in the resin of said at least one ribbon.

4. A deicing device as claimed in claim 2, wherein said at least one ribbon has a length determined as a function of the resistance to be obtained including a part of said at least one ribbon covered by said tubular metal mesh element.

5. A deicing device as claimed in claim 1, wherein components parts of a heating cover, formed by the at least one ribbon, the insert layer and the two layers of a preimpregnated composite fiber material, are joined together, and joined on the wing structure by polymerization when heated and under pressure.

* * * * *